US005547310A

United States Patent [19]

Muller

[11] Patent Number: 5,547,310

[45] Date of Patent: Aug. 20, 1996

[54] BARRIER CONSTRUCTION FOR REMOVABLY CLOSING ROAD PASSAGES

[76] Inventor: Franz M. R. Muller, Via Tolstoi, 45, 20098, San Giuliano Milanese (Milano), Italy

[21] Appl. No.: 420,022

[22] Filed: Apr. 11, 1995

[30] Foreign Application Priority Data

Apr. 18, 1994 [IT] Italy ..... MI94A0745

[51] Int. Cl.[6] ..... E01F 13/00

[52] U.S. Cl. ..... 404/6; 256/13.1; 404/9

[58] Field of Search ..... 404/6, 9, 10; 256/1, 256/13.1

[56] References Cited

U.S. PATENT DOCUMENTS 2,265,698 12/1941 Opgenorth ..... 256/13.1

4,819,916 4/1989 Wun-Chung ..... 256/13.1

*Primary Examiner*—Michael Powell Buiz
*Assistant Examiner*—Pamela A. O'Connor
*Attorney, Agent, or Firm*—Bucknam and Archer

[57] ABSTRACT

The present invention relates to a barrier construction for removably closing road passages, which comprises two cables, spaced from one another, and coupled, at the end portions thereof, to stretching assemblies, provided near the terminal portions of the end passage. Between the two cables are supported spacer plates, provided with a resting foot. The cables are arranged at such a level as to define therebetween the average of the values of the heights of the centers of gravity of conventional vehicles or, anyhow, such as to hold therein the minimum and maximum heights of a guard-rail of conventional type.

11 Claims, 3 Drawing Sheets

BARRIER CONSTRUCTION FOR REMOVABLY CLOSING ROAD PASSAGES

BACKGROUND OF THE INVENTION

The present invention relates to a barrier construction for removably closing road passages.

As is known, superhighways, autostradas, and, in general, roads provided with two roadways are protected along the central line thereof by traffic separating barriers, which can be made of cement concrete, or metal materials, or of free-ground portions, which, at preset distances, are interrupted by paved areas provided for allowing vehicles to change the running roadway, under the provided conditions.

This areas or regions are generally known as road passages, and have an average length of 30 meters.

The frequency with which these road passages are provided through the road barrier will depend on the environmental conditions, on the maintenance requirements, on the provision of outlets or other factors and, usually, is provided a road passage each 2 km of road.

Accordingly, this road passages represent an interruption of the side protection for the vehicle provided by the mentioned barriers.

Such an interruption is very dangerous, since accidents caused by traversing a road passage by vehicles are, even if reduced in number, very deleterious.

In fact, in such a case, the vehicle, frequently lacking of control by the driver, will impact against one or more vehicle coming in the opposite direction.

As such an accident occurs, the sum of the kinetic energies of the impacting vehicles is so high that it will cause the persons in the vehicles to die.

Because of this reasons, it has been considered the possibility of eliminating the road passages and closing them by fixed constructions of a barrier type.

Such a solution, however, has not been found fully satisfactory, because of maintenance reasons, emergency vehicle circulation reasons and snow removing reasons, as well as because of the need of changing roadway as serious accidents occur which obstruct a roadway for several hours.

These reasons, which must be traded-off with the safety of the road users, require the adoption of an efficient closing system but which, in the meanwhile, can be easily and quickly removed as this is necessary.

SUMMARY OF THE INVENTION

Accordingly, the aim of the present invention is to overcome the above mentioned problems, by providing a barrier construction, for removably closing road passages, which is adapted to safely resist against impacts, as provided by international rules for passengers and commercial vehicles, and which, moreover, can be easily removed as it is necessary.

Within the scope of the above mentioned aim, a main object of the present invention is to provide such a removable barrier construction, which can be installed and removed in a short time, without requiring the use of specifically designed or complex implements.

Another object of the present invention is to provide such a barrier construction, which, owing to its structural features, is very reliable and safe in operation.

Yet another object of the present invention is to provide such a barrier construction which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a barrier construction for removably closing road passages, characterized in that said barrier construction comprises at least two cables spaced from one another and coupled, at end portions thereof, to a stretching assembly arranged near terminal portions of said road passage, between said cables being supported spacer plates for said cables, said cables being arranged at such a height as to delimit therebetween an average of the values of the heights of the centers of gravities of conventional vehicles or, anyhow, the maximum and minimum height of conventional metal guard-rails.

BRIEF DESCRIPTION OF THE DRAWINGS

Further characteristics and advantages of the barrier construction according to the present invention will become more apparent hereinafter from the following detailed disclosure of a preferred, though not exclusive, embodiment thereof which is illustrated, by way of an indicative, but not limitative, example, in the figures of the accompanying drawings, where.

DESCRIPTION OF THE PREFERRED EMBODIMENTS

Figure 1:
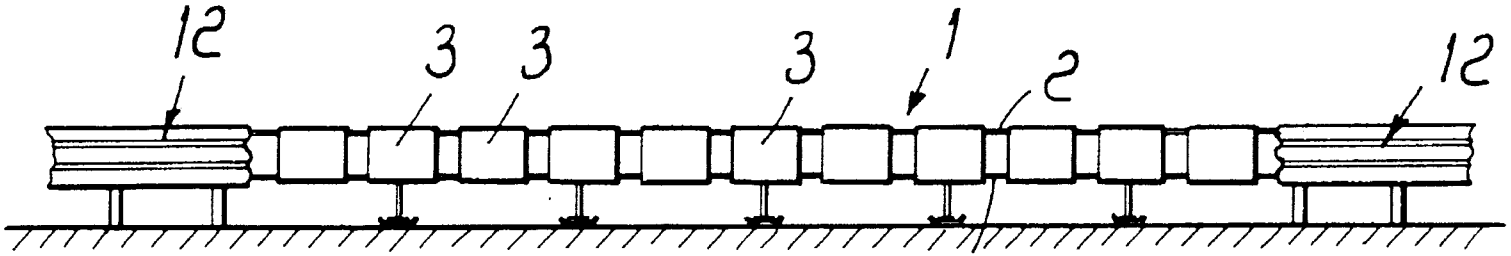
FIG. 1 schematically illustrates the barrier construction, according to the present invention, seen in elevation.
Figure 3:
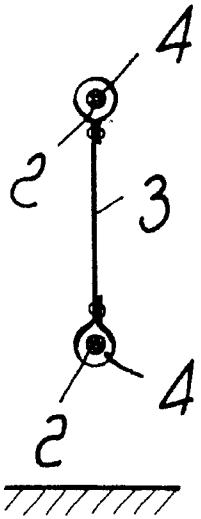
FIG. 3 illustrates a cross-sectional view substantially taken along the line III—III of FIG. 2.
Figure 2:
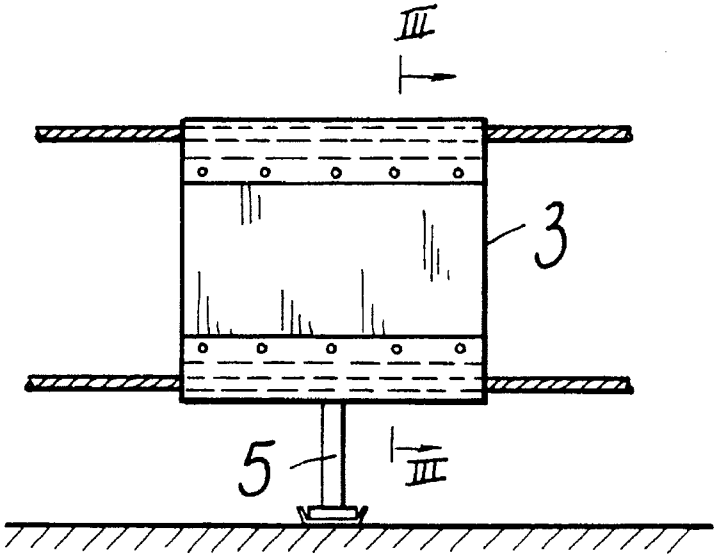
FIG. 2 illustrates the detail of a spacer plate.
Figure 4:
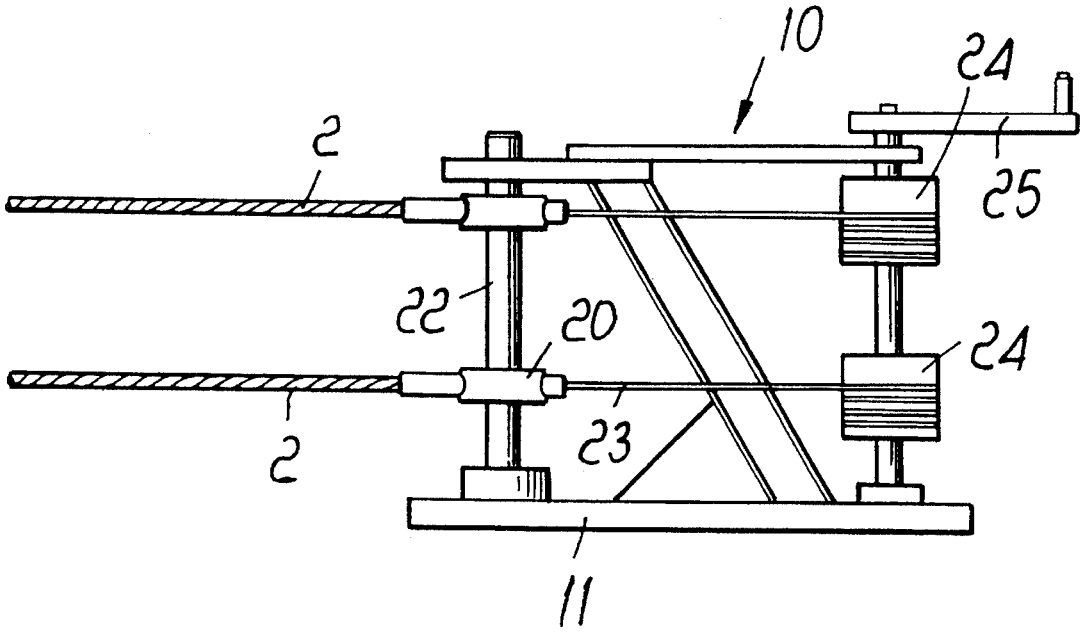
FIG. 4 is a schematic elevation view illustrating a stretching assembly.
Figure 5:
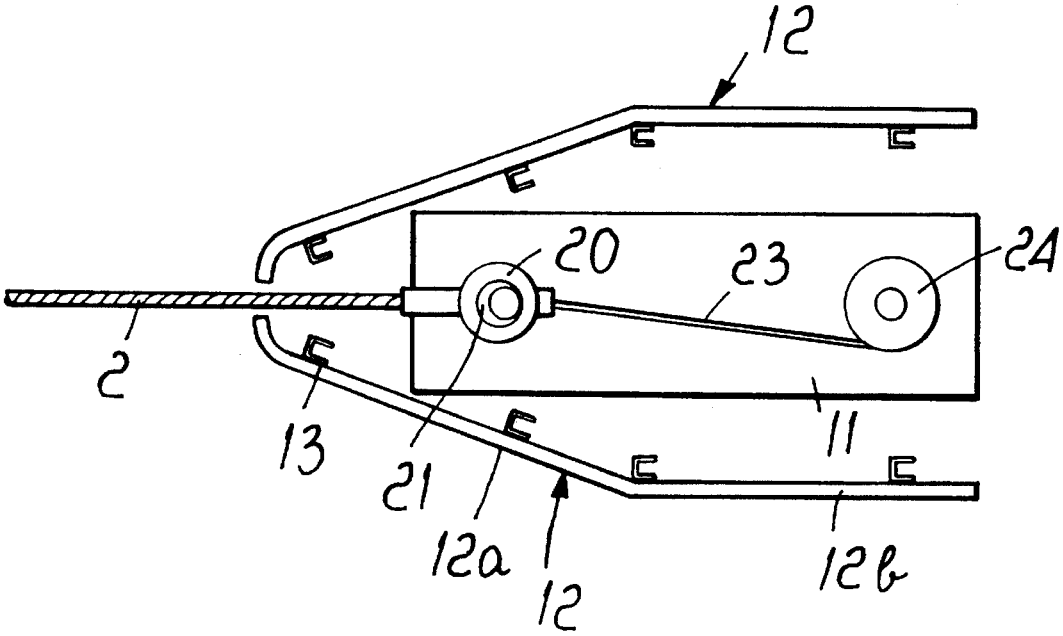
FIG. 5 is a top plan view of said stretching assembly.

With reference to the number references of the above mentioned figures, the barrier construction for removably closing road passages, according to the present invention, which has been generally indicated by the reference number 1, comprises at least two cables, indicated by 2, which are arranged spaced from one another and comprise metal cables or the like, which are coupled, at their end portions, under a pre-stretching condition.

The cables 2 are arranged, according to one aspect of the invention, at such a level as to include therebetween the average of the values of the heights of the centers of gravity of the normal vehicles or, anyhow, the maximum and minimum heights of an existing metal guard-rail.

The cables are held at the desired vertical distance by means of spacer plates, generally indicated by the reference number 3 which, advantageously, are provided, at the end or terminal portions thereof, with bent portions 4, which are affixed by means of screws, rivets, bolts or other suitable systems, so as to practically provide a channel for said cables 2.

Moreover, some plates 3 can be provided with resting feet 5, so as to prevent the cables from forming catenary curves.

According to a modified embodiment, the spacer plates 3 can also comprise plastic material panels, made, for example, by molding or contouring operations. More specifically, these panels will have any desired outer shape or color, and they could also have a side configuration resembling a double or triple wave, likewise the existing guard-rail assemblies.

Even in the case of panel-like spacer plates, some of the latter will be provided with resting feet, preferably of plastic materials, having the same function as the resting feet 5.

At the terminal or end portions of the cable 2, are provided stretching assemblies, generally indicated by the reference number 10, which will advantageously comprise a base plate 11 which is affixed on the ground by means of supporting and restraining elements, and is arranged inside shell elements 12.

These shell elements are advantageously made as double or triple wave guard-rails, which are supported by small poles 13.

The shell elements 12, in particular, are provided with a connection slanted portion 12*a*, which is directly coupled, or coupled through a connection part 12*b*, to the existing barrier construction, made either of a metal material or of cement concrete To the end portions of the cable 2 are fixed ring elements 20, providing a hole 21 for engaging therein a fixing pin 22.

The latter can be removably connected to the plate 11.

In order to pre-stretch the cables, there are provided service small cables 23, connected to the ring elements 20, and wound on drums 24, which can be rotated, in order to perform the stretching of the cables, by means of a crank element 25, which, if desired, can be removable in order to prevent vandalic acts.

Figure 6:
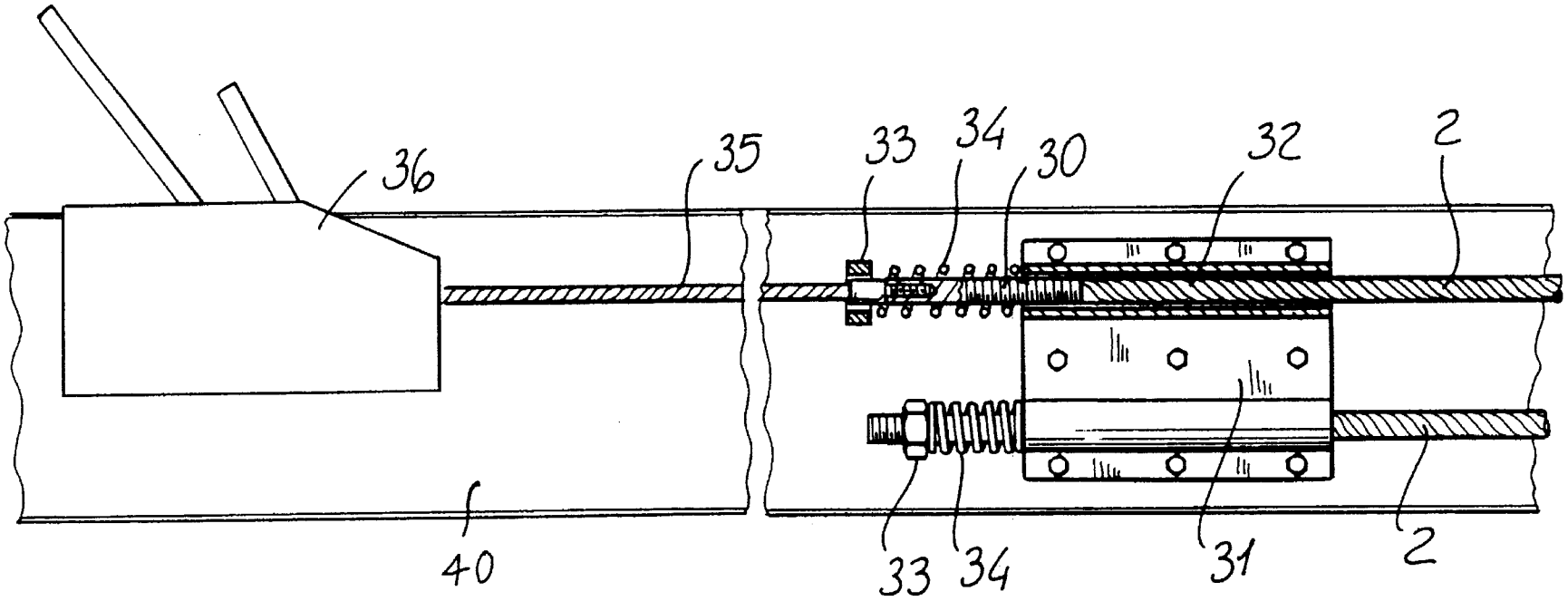
FIG. 6 illustrates a modified embodiment of a stretching assembly, which is directly coupled to the rear face of a guard-rail.

According to the modified embodiment schematically shown in FIG. 6, the stretching assemblies can be directly applied on the rear face of the existing guard-rail 40.

More specifically, it would be possible to provide, at the end portions of the guard-rail facing the road passage, plates having a plurality of lead-in holes to be traversed by the cables 2. In such a case, the cables 2 will be suitably provided, at their terminal portions, with end sleeves 30, threaded both on the outside and in the inside thereof.

In this case, on the rear face of the guard-rail 40, at a suitable distance from the road passage, usually included between 1 and 10 meters, preferably between 2 and 6 meters, will be affixed a strong plate 31, with a plurality of through-going holes 32 formed therethrough for allowing the passage of the cables 2. On this plate 31, the end sleeve 30 of the cables 2 will be affixed and pre-stretched by means of nuts 33, screwed on by conventional screwing or implements. Between the nuts 33 and plate 31, springs 34 can be arranged backlash or clearance recovering In order to recover the cables 2 and bring them to the point at which the pre-stretching operation is to be performed, service or operating small cables 35 will be connected to said cables, said small cables 35 coming from a flat winch assembly 36, for example of the type commercially known by the name of TIRFOR, possibly of a removable type, and affixed, at a rear-most position, on the rear face of the guard-rail 40.

The small cable 35 will be suitably provided with a threaded end portions to be coupled or engaged with the inner thread of the end sleeve 30 of the cables 2.

In this embodiment, the existing metal barrier will be suitably modified, with respect to the impact resistance thereof, so as to adapt it to the features required for an impacting vehicle.

From the above disclosure it should be apparent that the invention fully achieves the intended aim and objects.

In particular, it should be pointed out that the cable system according to the invention has been specifically designed for resisting against an angled impact of passengers and commercial vehicles and trailers, as provided by European rules, with only a dynamic deformation, so as to direct the vehicle to cause it to remain on its roadway.

With respect to the installation operations, upon having installed the anchoring and stretching end constructions, the cable system can be easily installed by maintenance operators, in particular two maintenance persons, with a possible aid of a servicing vehicle.

Likewise, in the case in which the road passage must be opened, these same maintenance persons can easily remove the cable system from an end assembly, and quickly bend it on itself at a side, or they can remove it from both its end portions and locate it inside the traffic separating barrier.

According to the preferred embodiment, the cables have a height from ground included between 200 and 1000 mm and are preferably arranged at a height from 200 to 700 mm.

Moreover, the cables can be replaced by chains or other rigid linear elements, connected to one another by hinge assemblies.

In order to cause the barrier to be easily seen, at the road passages, the spacing plates can be colored so as to clearly indicate the closure of the barrier to the traffic.

The invention as disclosed is susceptible to several modifications and variations, all of which will come within the scope of the invention.

Moreover, all of the details can be replaced by other technically equivalent elements.

In practicing the invention, the used materials, as well as the contingent size and shapes, can be any, depending on requirements.

I claim:

1. A barrier construction for removably closing road passages, comprising at least two cables spaced from one another and coupled, at the end portions thereof, to a stretching assembly arranged near terminal portions of a road passage, wherein between said cables are supported single piece spacer plates for said cables, said cables being arranged at such a height as to delimit therebetween an average of the values of the heights of the centers of gravities of conventional vehicles, said cables having a height from ground between 200 and 1000 mm and, preferably, 200 and 700 mm, and said single piece spacer plates are provided with bent edges to define a passage channel for said cables.

2. A barrier construction, according to claim 1, wherein said barrier construction further comprises, on at least a portion of said spacer plates, ground resting feet, in order to hold a constant height of said cables.

3. A barrier construction, according to claim 1, wherein said spacer plates comprise colored plastic material panels.

4. A barrier construction, according to claim 1, wherein said stretching assembly is placed inside protecting shells and is provided with a ground fixed plate.

5. A barrier construction, according to claim 4, wherein said cables are pre-stretched and locked against said plate by one or more nuts threaded on end portions of said cables and abutting against said plate.

6. A barrier construction, according to claim 5, wherein between said nuts and plate there are arranged clearance recovering springs.

7. A barrier construction, according to claim 1, further comprising a ring, fixed to an end of the cable and coupled to a pin connected to a fixing plate.

8. A barrier construction, according to claim 7, wherein said barrier construction comprises pre-stretching cables, coupled to ring elements and wound on winch assemblies for pre-stretching said cables.

9. A barrier construction, according to claim 8, wherein said stretching assembly comprises a plate connected to a rear side of an existing guard-rail and being provided with a plurality of throughgoing holes for allowing said pre-stretching cables to pass therethrough and be locked on said plate.

10. A barrier construction, according to claim 8, wherein said winch assemblies comprise removable handle assemblies.

11. A barrier construction, according to claim 8, wherein said winch assemblies are of a removable type.

* * * * *